US005512833A

United States Patent [19]

Fukuda et al.

[11] Patent Number: 5,512,833

[45] Date of Patent: Apr. 30, 1996

[54] CONNECTOR CHECKING DEVICE

[75] Inventors: Masaru Fukuda; Eiji Fukuda, both of Shizuoka, Japan

[73] Assignee: Yazaki Corporation, Tokyo, Japan

[21] Appl. No.: 294,572

[22] Filed: Aug. 23, 1994

[30] Foreign Application Priority Data

Aug. 24, 1993 [JP] Japan ..... 5-209147
Feb. 2, 1994 [JP] Japan ..... 6-010829

[51] Int. Cl.[6] ..... H01H 32/04; H01R 3/00

[52] U.S. Cl. ..... 324/538; 439/489

[58] Field of Search ..... 324/538, 66; 29/857, 29/888, 881; 439/488, 489

[56] References Cited

U.S. PATENT DOCUMENTS

| | | | |
|---|---|---|---|
| 4,902,968 | 2/1990 | Sugimoto | 324/538 |
| 5,108,305 | 4/1992 | Suzuki | 324/538 |
| 5,127,847 | 7/1992 | Kato et al. | 439/489 |
| 5,145,356 | 9/1992 | Minnis | 439/489 |
| 5,183,410 | 2/1993 | Inaba et al. | 439/489 |
| 5,330,369 | 7/1994 | Nozaki et al. | 439/488 |
| 5,335,413 | 9/1994 | Yamamoto et al. | 324/538 |

FOREIGN PATENT DOCUMENTS

| | | | |
|---|---|---|---|
| 53-18545 | 5/1978 | Japan . | |
| 55-8221 | 2/1980 | Japan . | |
| 62-47093 | 12/1987 | Japan . | |
| 64-27668 | 2/1989 | Japan . | |
| 0158772 | 7/1991 | Japan | 324/538 |
| 5288783 | 11/1993 | Japan | 324/538 |

*Primary Examiner*—Maura K. Regan
*Attorney, Agent, or Firm*—Armstrong, Westerman, Hattori, McLeland & Naughton

[57] ABSTRACT

A connector checking apparatus includes a connector checking device having a main body operable by a lever to move toward a connector. The connector checking device also has a connector support. Detection pins are slideably disposed within the main body and are connected to checking terminals. The detection pins have a conductive contact face and detection fingers on a detection piece. Upon insertion of the detection pins into the connector, complete insertion of the terminals within the terminal receiving cavities of the connector permits contact between the conductive face and an end of the terminal C. The connector has cantilever resilient supporting pieces which include a locking projection 14*a*. The device can detect whether or not the connector checking device A is completely engaged with the connector.

2 Claims, 8 Drawing Sheets

CONNECTOR CHECKING DEVICE

BACKGROUND OF THE INVENTION

1. Field of the Invention

The present invention relates to a checking device for a connector, which is used for connecting wiring harnesses in automobiles or the like, and more particularly to a device for checking whether or not terminals are properly installed at the predetermined position in the connector and whether or not the wires connected to the terminals keep right in continuity.

2. Description of the Prior Art

FIGS. 10A to 10C are cross-sectional views showing the process of inserting terminals into a connector. In the figures, a plurality of terminal receiving cavities b are formed in a connecter housing a, and cantilever resilient locking pieces c are attached to the terminal receiving cavities b to lock terminals d, which are inserted from the rear portion of the connector. At the insertion of the terminal d, a tip of the terminal d abuts a locking projection c1 of the resilient locking piece c to allow the piece c to bend toward a space e, as illustrated in FIG. 10B. Then, immediately after the locking projection c1 enters a locking opening d1 the resilient locking piece c returns to its original position to lock the terminal d as illustrated in 10C.

Reference symbol f is a connector checking device comprising cylindrical checking terminals, which oppose terminal receiving cavities b of the connector housing a, and pins h which are slidably mounted to the checking terminals g. The pins h are urged by coil springs i and project forwardly. Further, the checking device f is provided with a detection finger j for incomplete insertion of the terminals d.

Under the condition that the connector housing a, which is checked by the connector checking device f, is mounted on the checking device f as illustrated in FIG. 11, the detection finger j proceeds into the space e, and the terminal d, which is completely inserted and locked under the detection finger j, is in press-contact with the pin h, while the pin h moves rearward, so that a continuity detector k determines that the connection of the terminal d to the connector is complete. On the other hand, when the terminal d, which is not locked by the resilient locking piece c, is not in contact with the pins h, the continuity detector k verifies that the connection of the terminal to the connector is incomplete.

Under the condition shown in FIG. 12, an upper terminal d is situated at an incompletely connected position in which the terminal d bends the resilient locking piece c. Therefore, even if a worker tries to engage the connector housing a to the checking device f, the detection finger j abuts an end face of the upper resilient locking piece c covering the space e, which prevents the housing a from being engaged to the checking device f. As a result, the incomplete insertion of the terminal d is verified.

With the construction of the conventional connector checking device described above, when the terminal d is in the incompletely connected state the detection finger j can not proceed into the space e, so that the all terminals can not be checked even though the only one terminal is incompletely inserted.

SUMMARY OF THE INVENTION

It is therefore the object of the present invention to eliminate the drawbacks of the conventional connector checking device and to provide a connector checking device in which the terminals are respectively checked by the pins h.

In order to achieve the object, the connector checking device according to the present invention comprises: a connector support for supporting a connector with a plurality of terminal receiving cavities; a main body independently movable to and from the connector support; and a plurality of detection pins inserted in the main body and urged toward the connector support by springs, the detection pins being connected to detecting electrical circuits, each of the detection pins having a conductive contact face and a detection finger for incomplete insertion positioned ahead of the conductive contact face; wherein, in checking the connector, when the terminal is completely inserted said conductive contact face comes in contact with said terminal supported by a cantilever resilient supporting piece of the connector, while said detection finger for incomplete insertion can proceed into the space where said cantilever resilient supporting piece is allowed to deflect by being bent.

Further, a tapered contact face is preferably formed at a tip of the detection finger for incomplete insertion, and the tapered contact face opposes the tapered guide face formed at the front end of the side wall with the cantilever resilient supporting piece in the terminal receiving cavity of the connector.

On the other hand, when the terminal is incompletely inserted, the detection finger for incomplete insertion abuts an end of the resilient supporting piece, which is being deflected by the terminal, and is prevented from entering the space where the resilient supporting piece is allowed to deflect by being bent. Hence, the conductive contact face of the detection pin can not come in contact with the terminal. As a result, the detecting electrical circuit is opened. In checking operation, the tapered contact face formed at a tip of said detection finger for incomplete insertion engages the tapered guide face at a front portions of the side wall in the terminal receiving cavity of the connector, and then, the detection pin is guided into the terminal receiving cavity of the connector.

BRIEF DESCRIPTION OF THE DRAWINGS

The present invention will be more apparent from the ensuing description with reference to the accompanying drawing wherein.

DETAILED DESCRIPTION OF PREFERRED EMBODIMENTS

Figure 1:
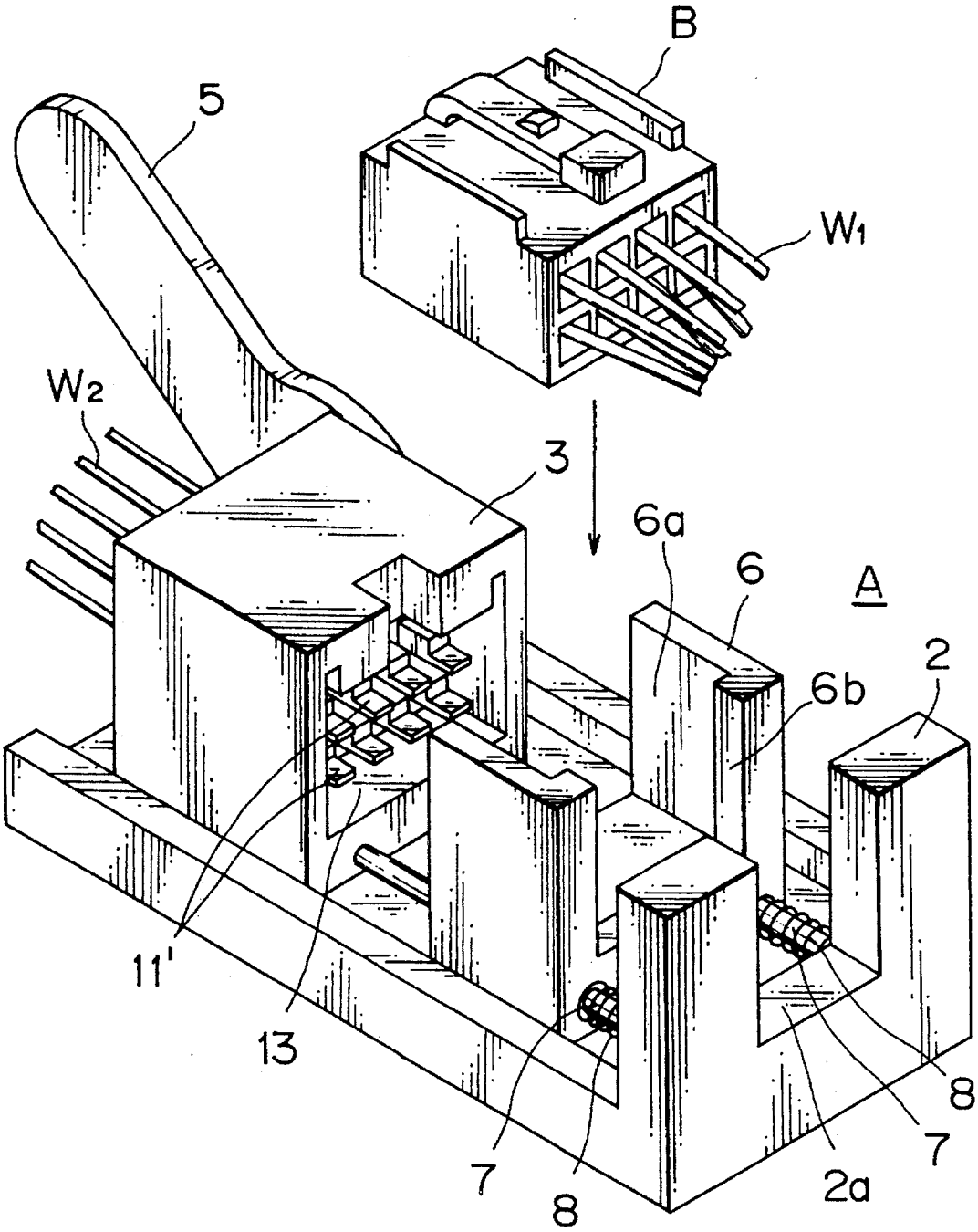
FIG. 1 is a perspective view of a connector checking device according to an embodiment of the present invention.

Referring to FIGS. 1 to 4, a connector checking device A is provided with a fixed wall 2 having a wire delivery opening 2*a* at an end of a base 1, and a main body 3 of the connector checking device A is movably mounted at another end portion of the base 1. The main body 3 moves back and forth by means of an operation lever 5 which is rotatably supported by a shaft 4.

A connecter support 6 is formed between the fixed wall 2 and the checking device main body 3. The connector support 6 has a shape of a frame without an upper wall, and a connector receiving chamber 6*a* is provided in the support 6. A wire delivery opening 6*b* is formed on the side of the fixed wall 2. The connector support 6 is urged toward the checking device main body 3 by a coil springs 8 attached to guide shafts 7 projecting from the fixed wall 2 to the connector support 6. The connector support 6 retreats against the coil springs 8 when pressurized by the checking device main body 3.

Figure 2:
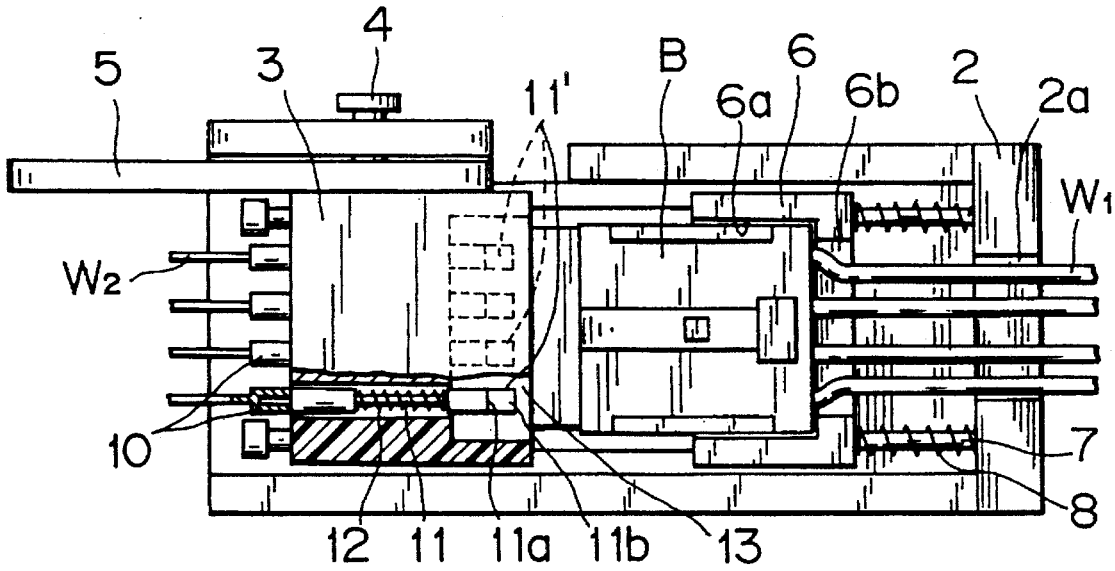
FIG. 2 is a plan view of the connector checking device in FIG. 1.
Figure 3:
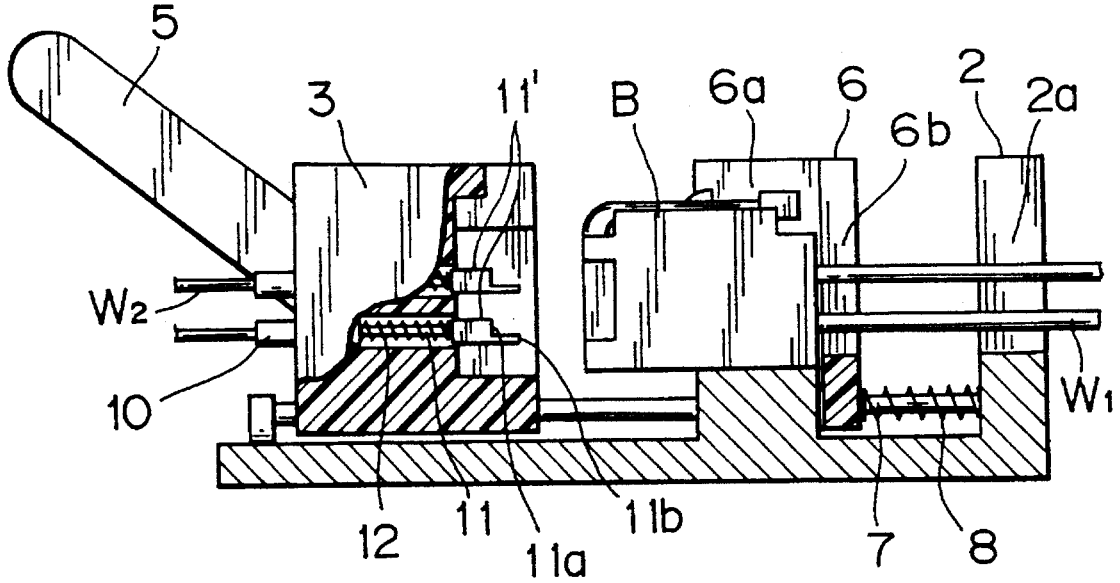
FIG. 3 is a partially fragmented front view of the connector checking device shown in FIG. 1.
Figure 4:
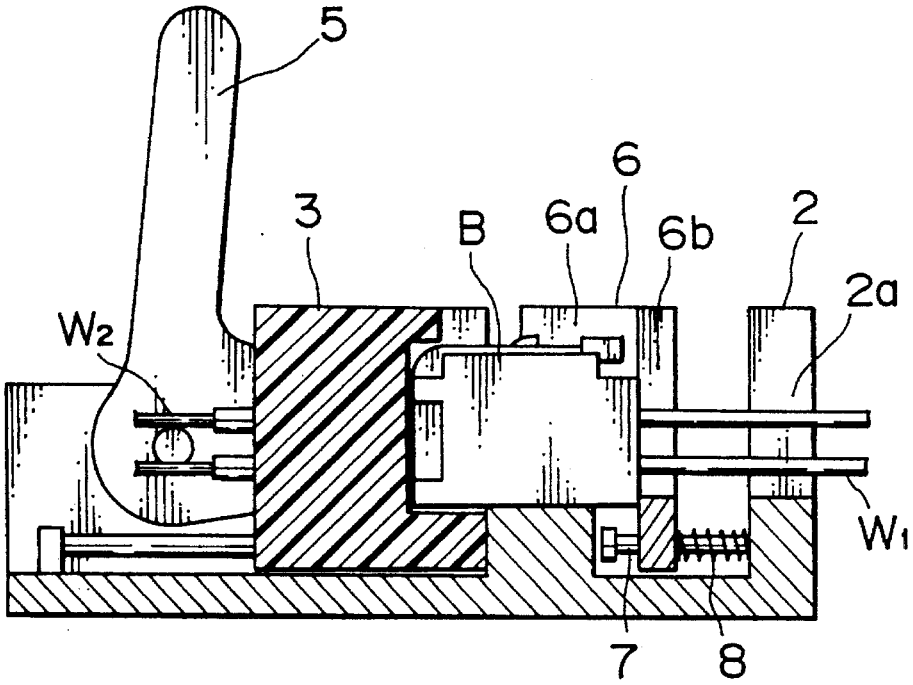
FIG. 4 is a partially fragmented front view of the connector shown in FIG. 1 under inspection.
Figure 5:
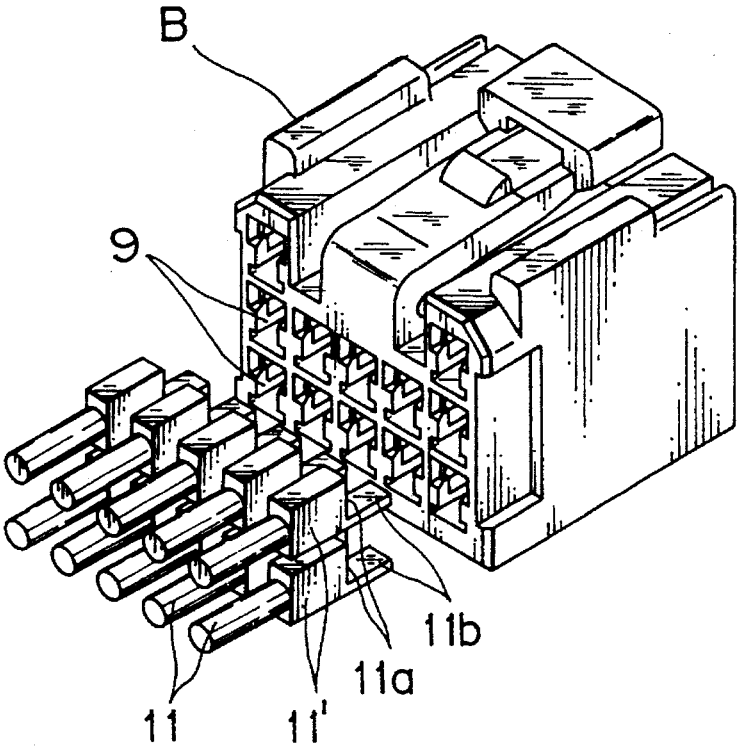
FIG. 5 is a perspective view of check pins and the checked connector.

A connector B is inserted into the connector support 6 from the upper side, and wires W1 of the connector B are guided in the wire delivery openings 6*b* and 2*a* as illustrated in FIGS. 2 to 4.

In the checking device main body 3, a plurality of checking terminals 10 are mounted in accordance with a plurality of terminal receiving cavities 9 of the connector B. Further, detect,on pins 11 are slidably mounted in the checking terminals 10, and the detection pins 11 are urged by coil springs 12 and project in a checking chamber 13.

Figure 6:
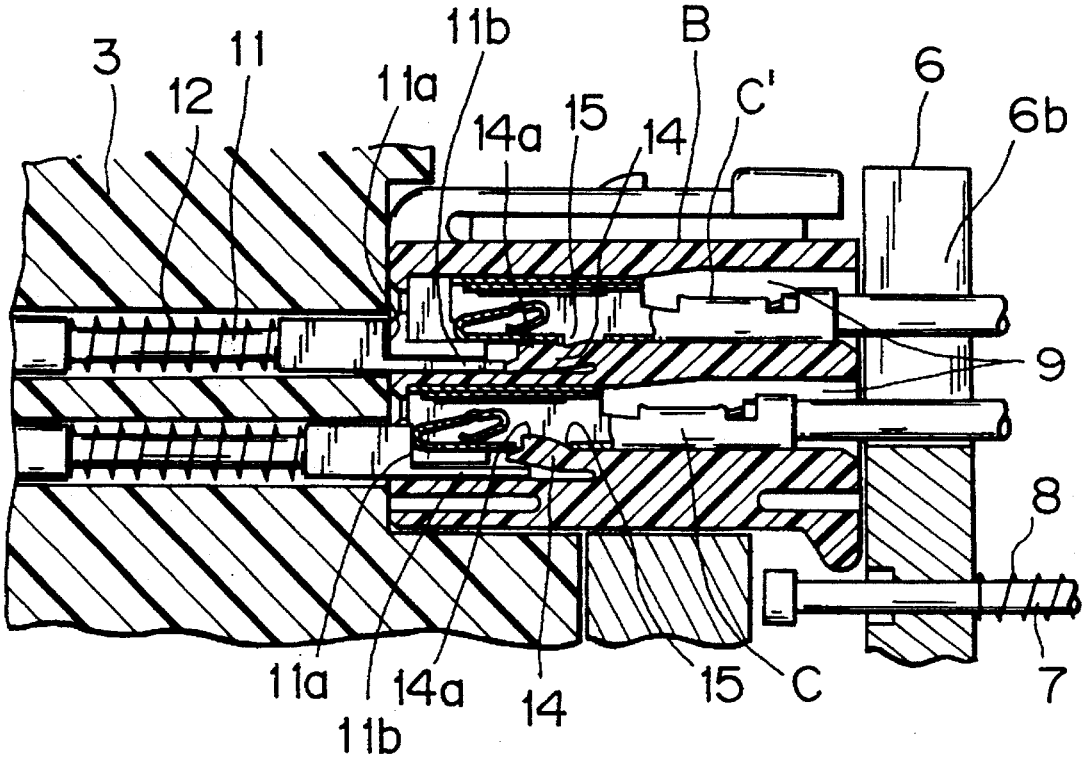
FIG. 6 is a cross-sectional view of the checked connector under inspection.

At a tip of the detection pin 11, there is provided a detection piece 11' with a detection finger for incomplete insertion 11*b* forwardly projecting at an end of a conductive contact face 11*a*. Each detecting terminal 10 is connected to a continuity checking device (not shown) with a lead wire W2. In the inspection, the operation lever 5 is rotated to proceed the main body 3 of the checking device, so that the detection piece 11' is in contact with the terminal C while a front portion of the connector B is received in the detection chamber 13. Under the condition indicated in FIG. 6, a terminal C accommodated in a lower terminal receiving cavity 9 of the connector B is completely inserted and a locking projection 14*a* of a cantilever resilient supporting piece 14 enters a locking hole 15 of the terminal C to cause the resilient supporting piece 14 to fully return to its original position, but, another terminal C' in an upper terminal receiving cavity 9 is incompletely inserted so that the resilient supporting piece 14 remains bent by the terminal C' because of a locking projection 14*a*.

When the connector B under the above condition is checked, the detection finger 11*b* of the detection pin 11 for the terminal C enters a space 16 for allowing the deflection of the resilient supporting piece 14, which permits the contact face 11*a* to come in contact with the terminal C to close a detecting electrical circuit. On the other hand, as the detection finger 11*b* of the detection pin 11 for the terminal C' abuts an end of the resilient supporting piece 14, the detection finger 11*b* of the detection pin 11 is prevented from entering the space 16 so that the terminal C' can not come in contact with the contact face 11*a*. As a result, the detecting electrical circuit is opened so that the continuity checking device verifies that the connection of the terminal is incomplete.

Figure 7:
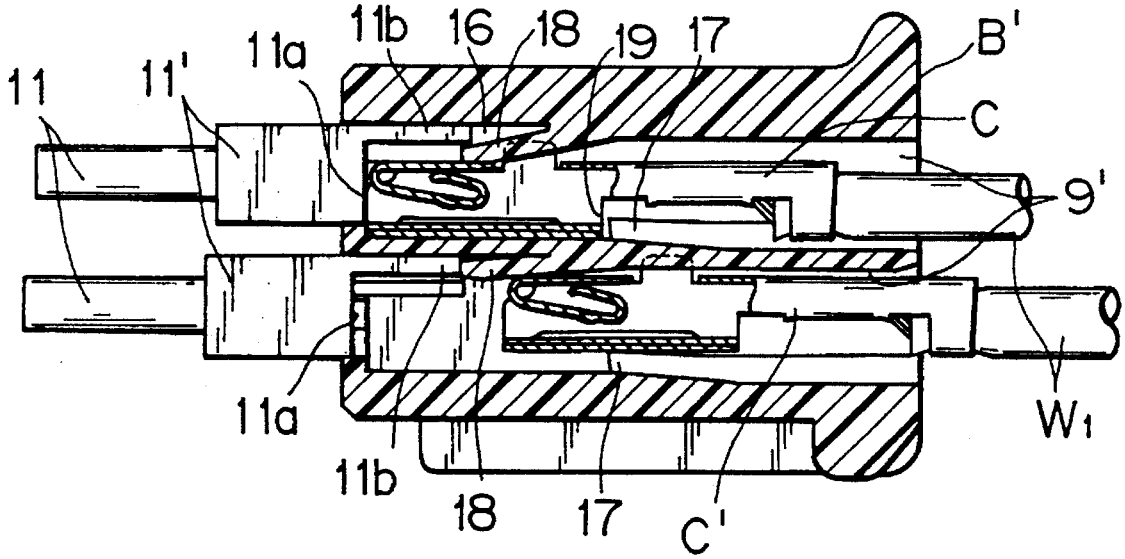
FIG. 7 is a cross-sectional view of another connector under inspection.

FIG. 7 shows a connection according to another embodiment of the present invention. A shoulder 17 for fixing a terminal C is formed at an end of a terminal receiving cavity 9' of a connector B', and the resilient supporting piece 18 is provided at the other end of the terminal receiving cavity 9'. When the terminal C is completely inserted, a shoulder 19 engages the shoulder 17 and the resilient supporting piece 18 pushes the terminal C to maintain the locking condition of the terminal C. On the other hand, when the terminal C' is incompletely inserted, the shoulder 19 of the terminal C' rides on the shoulder 7 so that the resilient supporting piece 18 does not return to its original position. As a result, the detection finger 11*b* of the detection pin 11 can enter the space 16 at the complete insertion of the terminal C, but, when the terminal C' is incompletely inserted the detection finger 11*b* abuts an end of the resilient supporting piece 18, which prevents the detection finger 11*b* of the detection pin 11 from entering the space 16.

Figure 8:
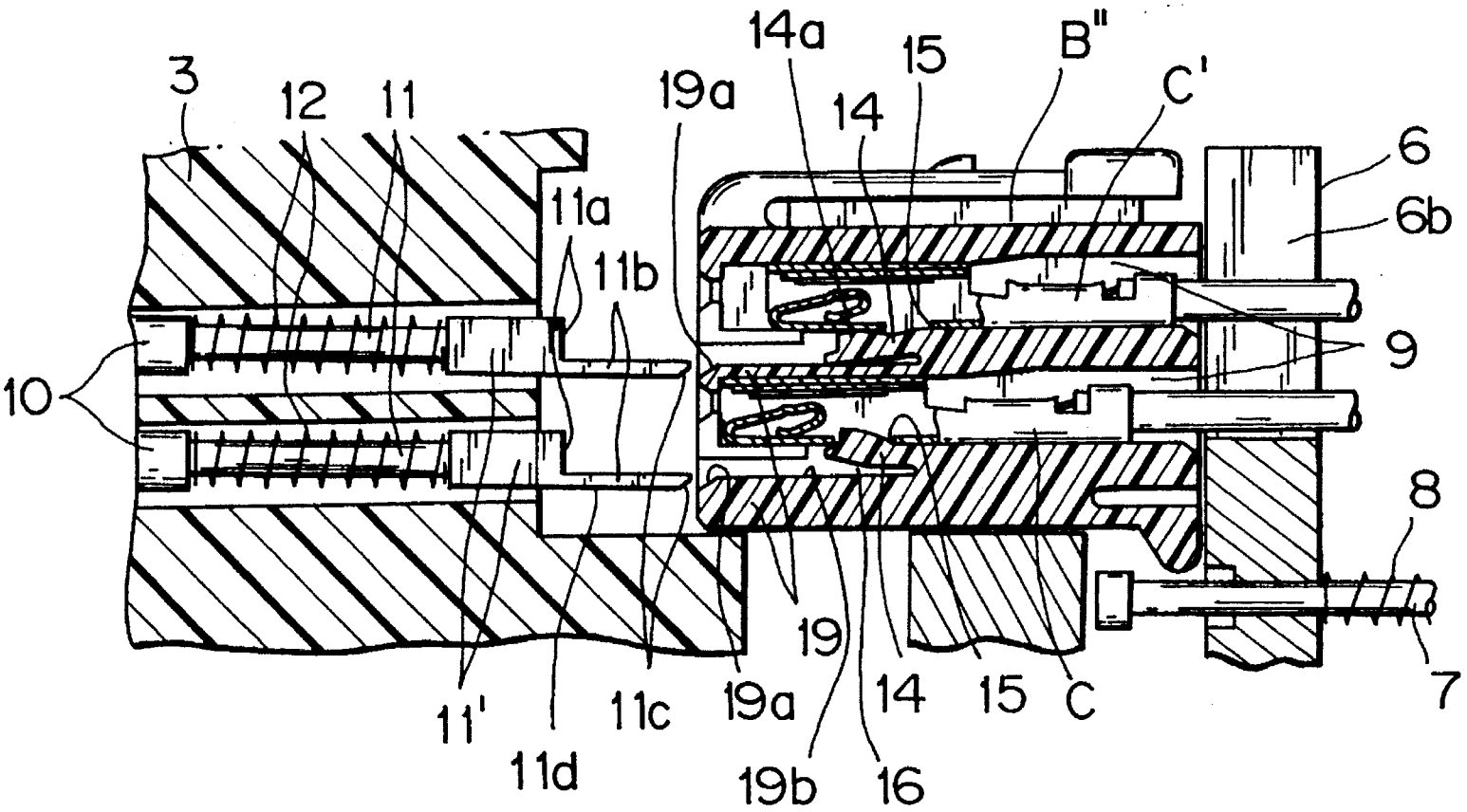
FIG. 8 is a cross-sectional view of a further connector and the connector checking device before inspection.

FIG. 8 shows a connector checking device according to a still another embodiment of the present invention. Tapered guide face 19*a* is formed at an inner front end of the side wall 19 having the resilient supporting piece 14 in the terminal receiving cavities 9 of a connector B", and tapered contact face 11*c* is formed at an outer side of a tip of the detection finger 11*b* of the detection pin 11. The detection pin 11 is supported at a base portion thereof on the detecting terminal 10 so as to deviate in the direction vertical to the axis of the detecting terminal 10. The tapered contact face 11*c* is situated so as to oppose the tapered guide face 19*a*.

Figure 9:
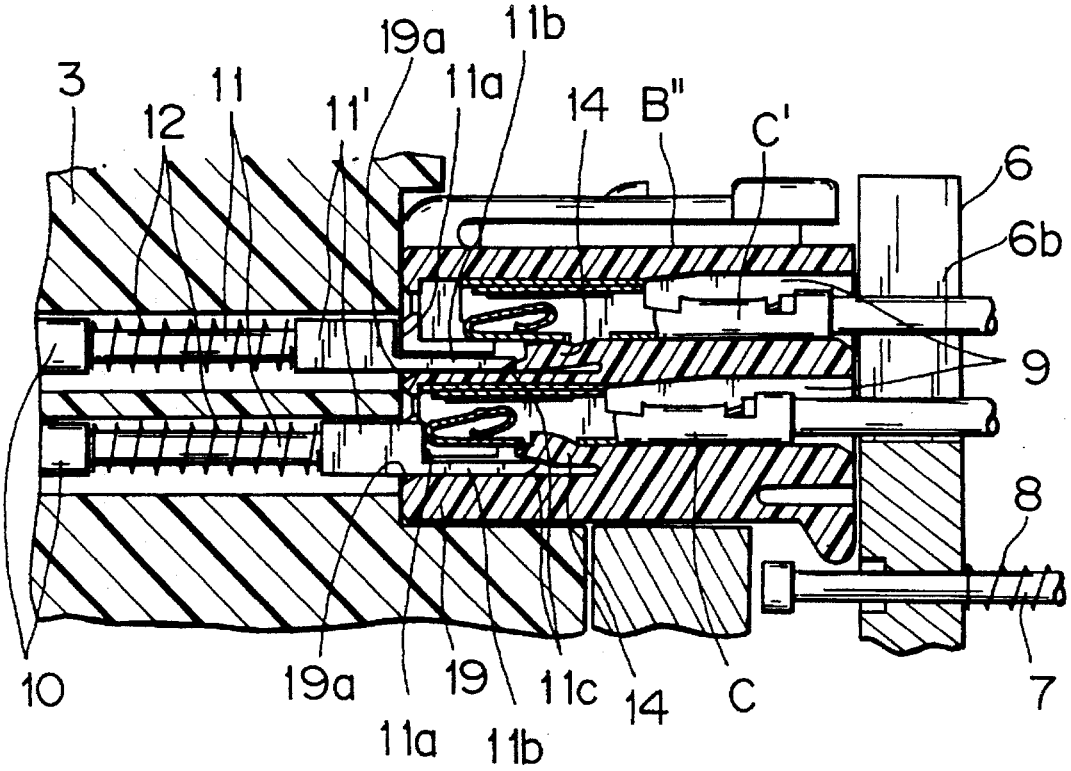
FIG. 9 is a cross-sectional view of a still further connector and another connector checking device under inspection.
Figure 10A:
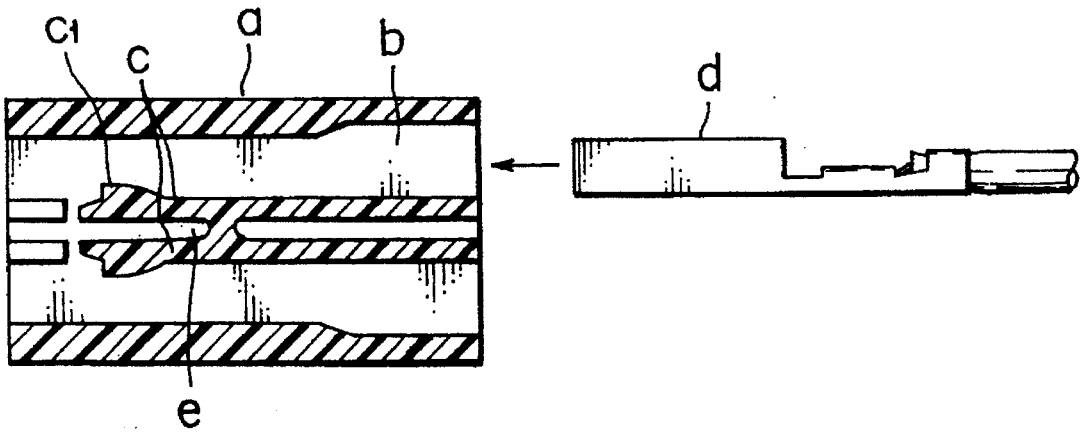
FIG. 10A PRIOR ART
FIGS. 10A to 10C are cross-sectional views showing the process of inserting terminals into a connector.
Figure 10B:
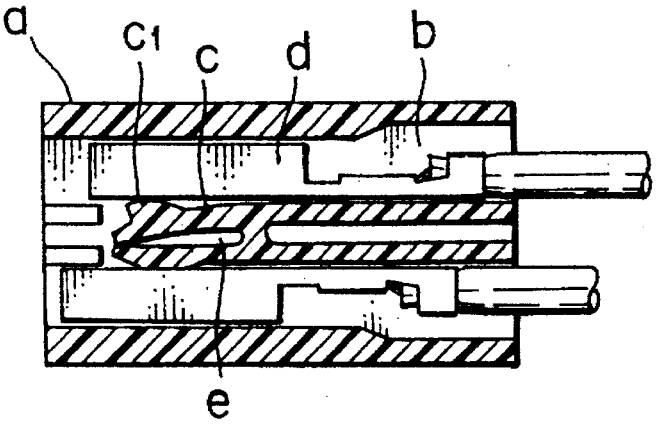
FIG. 10B PRIOR ART
Figure 10C:
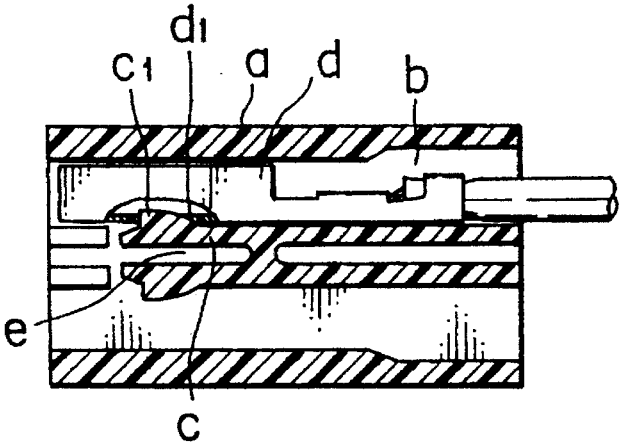
FIG. 10C PRIOR ART
Figure 11:
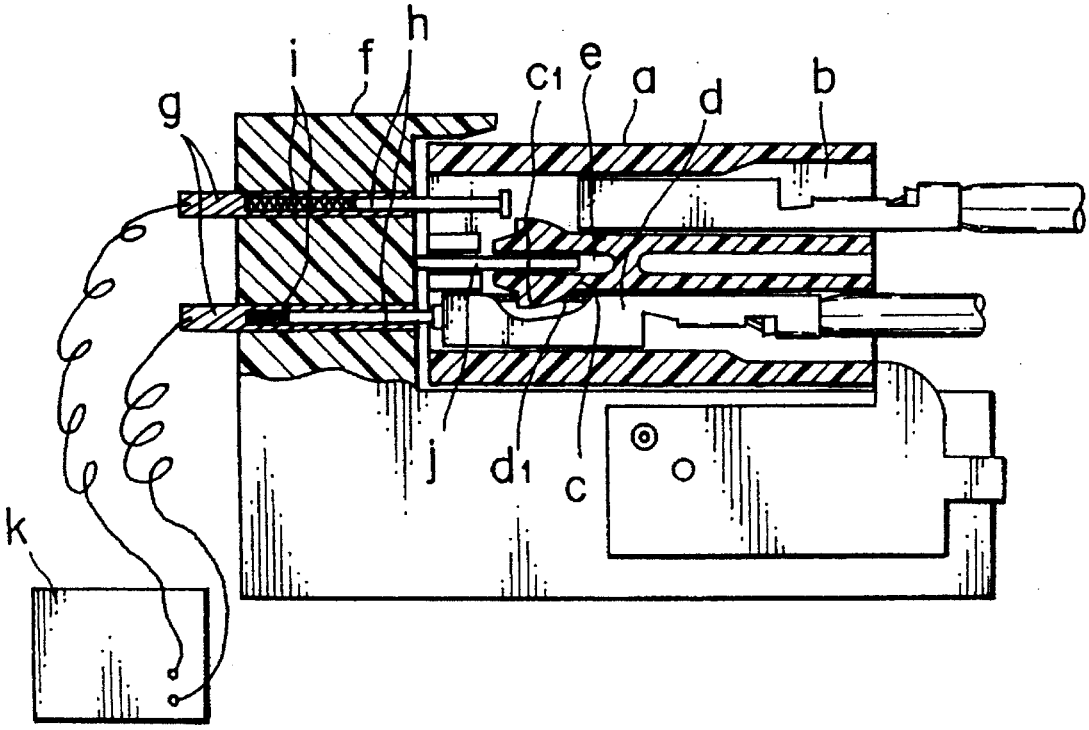
FIG. 11 PRIOR ART
FIG. 11 is a cross-sectional view of a conventional connector checking device under inspection.
Figure 12:
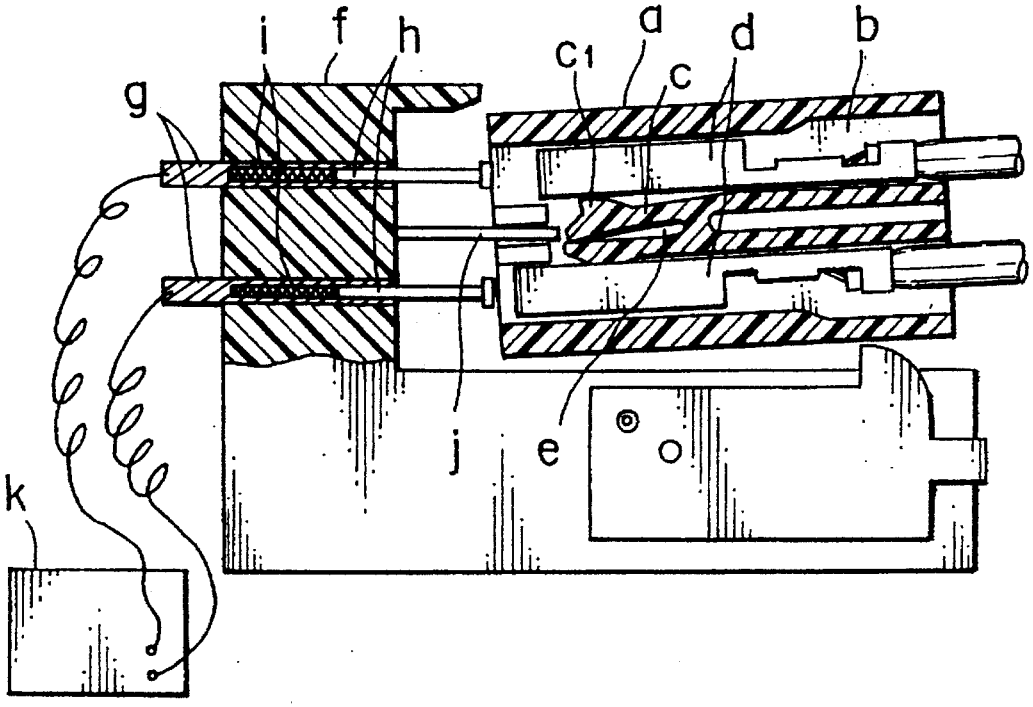
FIG. 12 PRIOR ART
FIG. 12 is a cross-sectional view of the conventional connector checking device inspecting another condition of the same connector as illustrated in FIG. 11.

Referring to FIG. 9, under the condition described above, when the checking device main body 3 proceeds at the inspection, the tapered contact faces 11*c* at the front ends of the detection fingers 11*b* abut the tapered guide faces 19*a* at a front portions of the side walls 19 of the connector B" and are introduced into the terminal receiving cavities 9. Then, the contact face 11*a* of the detection pin 11 contacts the terminal C to close the detecting electrical circuit. On the other hand, at the incomplete insertion of the terminal C', the contact face 11*a* of the detection pin 11 can not come in contact with terminal C' so that the detecting electrical circuit is opened and the detector verifies the incomplete insertion of the terminal C'.

The construction described above is effective when the connector B" is small and a number of small terminal receiving cavities are densely built-up to securely introduce the detection pins 11 into the terminal receiving cavities 9. Further, the inner face 19*b* of the side wall of the connector B" and a bottom face 11*d* of the detection pin can coincide with each other without fail, so that the base lines for the detection pin 11 and space 16 coincide with each other, which facilitates the determination of the diameter of the inserted detection pin 11.

As described above, the present invention is comprising: a connector support for supporting a connector with a plurality of terminal receiving cavities; a main body independently movable to and from said connector support; and a plurality of detection pins inserted in said main body and urged toward the connector support by springs, said detection pins connected to detecting electrical circuits, each of said detection pins having a conductive contact face and a detection finger for incomplete insertion positioned ahead of said conductive contact face; wherein, in checking the connector, when the terminal is completely inserted, said conductive contact face comes in contact with said terminal supported by a cantilever resilient supporting piece of the connector, while said detection finger for incomplete insertion can proceed into the space where said cantilever resilient supporting piece is allowed to deflect by being bent. Therefore, the incomplete insertion of the each terminal can be checked respectively, resulting in a great improvement in the inspection efficiency.

Moreover, in the present invention, a tapered contact face is formed at a tip of said detection finger for incomplete insertion, and said tapered contact face opposes the tapered guide face formed at a front end of a side wall with the cantilever resilient supporting piece in the terminal receiving cavity of the connector. Hence, even when a number of comparatively small terminal receiving cavities are densely built-up, the detection pins can be securely introduced into the each terminal receiving cavity corresponding to the each the detection pin.

What is claimed is:

1. A connector checking device comprising:

a connector support for supporting a connector with a plurality of terminal receiving cavities, wherein the connector has a cantilever resilient supporting piece for supporting a terminal;

a main body independently movable to and from said connector support; and a plurality of detection pins disposed in said main body and urged toward the connector support by resilient means, said detection pins being connected to detecting electrical circuits, each of said detection pins having a conductive contact face and a detection finger extending beyond said conductive contact face;

wherein, said main body is moved toward said connector support for checking to determine whether the terminal is completely inserted within the connector, such that when the terminal is completely inserted within the connector, contact occurs between the terminal and said conductive contact face, whereas when the terminal is incompletely inserted with the connector, said detection finger proceeds into a space in said connector where said cantilever resilient supporting piece deflects by being bent; and wherein said connector includes a terminal receiving cavity and a tapered guide face is formed at a front end of a side wall with the cantilever resilient supporting piece in the terminal receiving cavity of the connector; and wherein a tapered contact face is formed at a tip of said detection finger such that, when incomplete insertion occurs, and said tapered contact face opposes the tapered guide face formed at the front end of the side wall with the cantilever resilient supporting piece in the terminal receiving cavity of the connector.

2. A connector checking device comprising in combination:

a connector having a plurality of terminal receiving cavities, each of said terminal receiving cavities respectively having a cantilever resilient supporting piece supporting a terminal therein;

a connector checking member having a base, a connector support for supporting said connector, and a main body selectively movable toward and away from said connector support;

a plurality of detection pins disposed in said main body; and urging means for urging said plurality of detection pins toward said connector support, each of said detection pins being respectively connected to detecting electrical circuits, and each of said detection pins having a conductive contact face and a detection finger extending beyond said conductive contact face toward said connector support;

wherein, said main body is moved toward said connector support for checking to determine whether the terminal is completely inserted within said connector, such that when the terminal is completely inserted within said connector, contact occurs between said terminal and said conductive contact face, whereas when the terminal is incompletely inserted with the connector, said detection finger proceeds into a space in said connector where said cantilever resilient supporting piece deflects by being bent so that no electrical contact occurs between said terminal and said conductive contact face;

wherein said connector includes a terminal receiving cavity and a tapered guide face is formed at a front end of a side wall with the cantilever resilient supporting piece in the terminal receiving cavity of the connector; and wherein a tapered contact face is formed at a tip of said detection finger such that, when incomplete insertion occurs, and said tapered contact face opposes the tapered guide face formed at the front end of the side wall with the cantilever resilient supporting piece in the terminal receiving cavity of the connector.

* * * * *